United States Patent [19]

Lu

[11] Patent Number: 4,966,339

[45] **Date of Patent: * Oct. 30, 1990**

[54] KNIFE STAND

[76] Inventor: Keh J. Lu, No. 16, Ching Mei Road, Taiping Hsiang, Taichung, Taiwan

[ * ] Notice: The portion of the term of this patent subsequent to Jun. 19, 2007 has been disclaimed.

[21] Appl. No.: 424,391

[22] Filed: Oct. 20, 1989

Related U.S. Application Data

[63] Continuation of Ser. No. 142,646, Jan. 11, 1988.

[51] Int. Cl.[5] ..... A47F 1/00

[52] U.S. Cl. ..... 248/37.3; D7/637; 211/70.7

[58] Field of Search ..... 248/37.3, 37.6, 152, 248/312, 312.1; D7/73, 74; 211/70.6, 70.7; 206/553; 30/296 R, 296 A

[56] References Cited

U.S. PATENT DOCUMENTS

D. 115,926 8/1939 Hopkins .
D. 163,526 4/1949 Kampa .
D. 165,894 2/1952 Adler .
D. 178,993 10/1956 Georgan .
D. 266,136 9/1982 Peabody .
1,937,424 11/1933 Champlin .
2,371,433 3/1945 Davis .
2,903,211 9/1959 Weinstock .
3,187,902 6/1965 Nelson .
4,561,548 12/1985 Call .

OTHER PUBLICATIONS

Washington Forge advertisment, HFD, Mar. 25, 1986, p. 172.

*Primary Examiner*—Ramon O. Ramirez
*Assistant Examiner*—Robert A. Olson
*Attorney, Agent, or Firm*—Clifford A. Poff

[57] ABSTRACT

A knife stand includes a resting body having a front surface and a top surface, a front piece secured to the front surface, having parallel through slits and having the top thereof higher than the top surface, and a plurality of positioning means each of which is formed on the resting body and capable of positioning thereon the handle of a knife and has a slit corresponding to and communicating with one of the through slits so that one can let the blade of the knife pass through the one through slit and have the end of the handle from which the blade is fixed to the handle positioned in the each positioning means and against the rear surface of the top of the front piece.

7 Claims, 6 Drawing Sheets

KNIFE STAND

This is a continuation of co-pending application Ser. No, 142,646 filed on Jan. 11, 1988, pending.

BACKGROUND OF THE INVENTION

The present invention relates to a stand, and more particularly to a knife stand.

A kitchener of a family always needs kinds of knives are dangerous, it is necessary and convenient for use to store these knives on a knife stand. Conventionally, a knife stand is designed to be two spaced bars secured to the wall in the kitchen with the blades of knives pendent beneath the spaced bars and the handles of knives suspended on the spaced bars. This design has the following disadvantages:

(1) If a knife stored on the spaced bars is to be used, one needs to pull upwardly the full length of the blade of the knife;

(2) The area on the wall above the place where the spaced bars are secured to the wall must be left free enough in order not to result in any interference or danger upon one's taking knife from the spaced bars; and (3) Normally, the groove between the spaced bars is not divided and therefore one knife will occasionally interferer with one's taking another knife therefrom.

Another prior art known by the Applicant is a portable knife stand having a plurality of grooves capable of receiving therein the knife blades. Nevertheless, the above disadvantages (1) & (2) are not overcome thereby.

It is therefore tried by the Applicant to obviate the above shortcomings encountered by the prior art.

SUMMARY OF THE INVENTION

It is therefore an object of the present invention to provide a knife stand enabling that one need not pull upwardly the full length of a knife blade in order to take a knife therefrom.

It is another object of the present invention to provide a knife stand capable of being mounted on a crowded wall space in a kitchen.

According to the present invention, a knife stand includes a resting body, a front piece secured to the resting body, having parallel through slits and having the top thereof higher than the resting body, and positioning means each of which is formed on the resting body and capable of positioning thereon the handle of a knife and has a slit corresponding to and communicating with one of the through slits so that one can let the blade of the knife pass through the one through slit and have the end of the handle from which the blade is fixed to the handle positioned in the each positioning means and against the rear surface of the top of the front piece.

The present invention may best be understood through the following description with reference to the accompanying drawings, in which

DETAILED DESCRIPTION OF THE PREFERRED EMBODIMENTS

Figure 1:
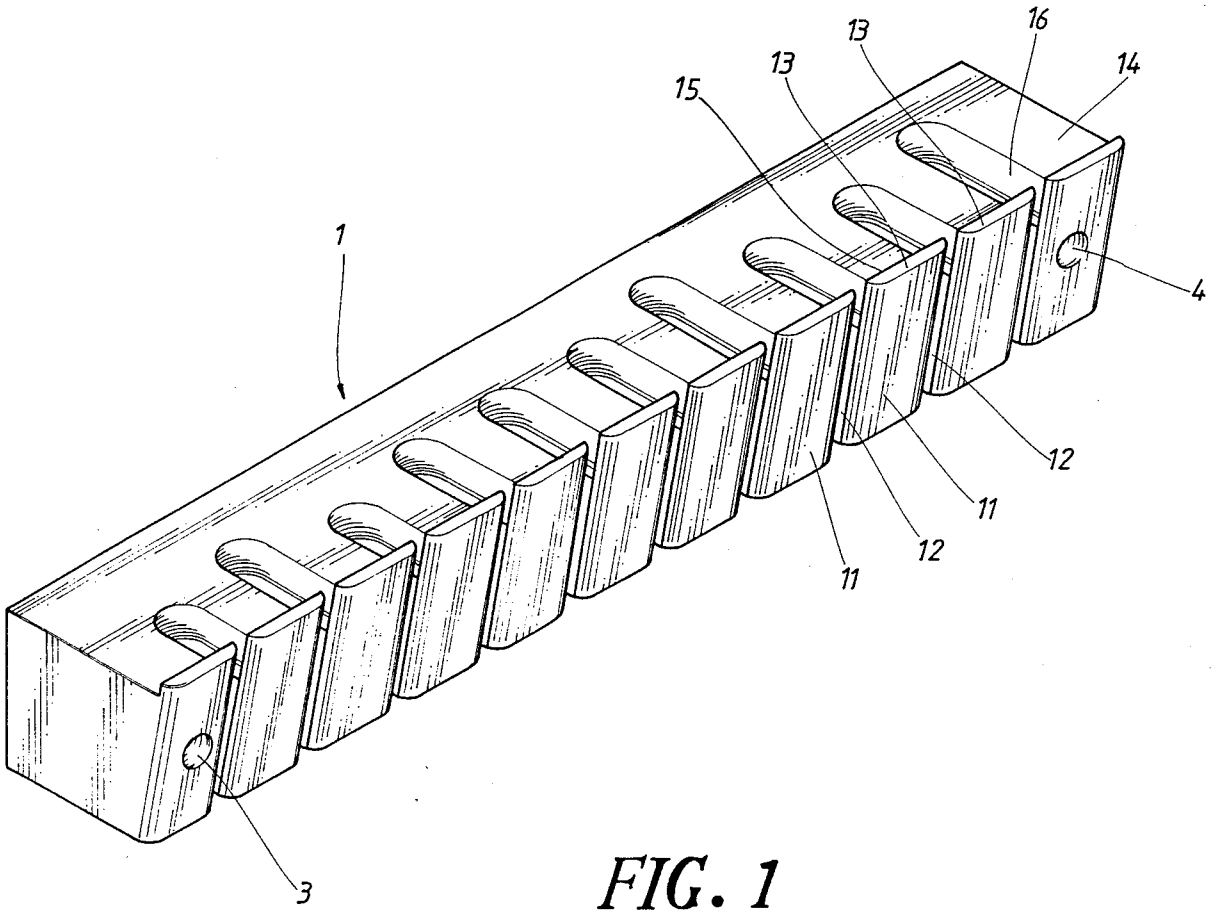
FIG. 1 is a perspective view showing a preferred embodiment of a knife stand according to the present invention.
Figure 2:
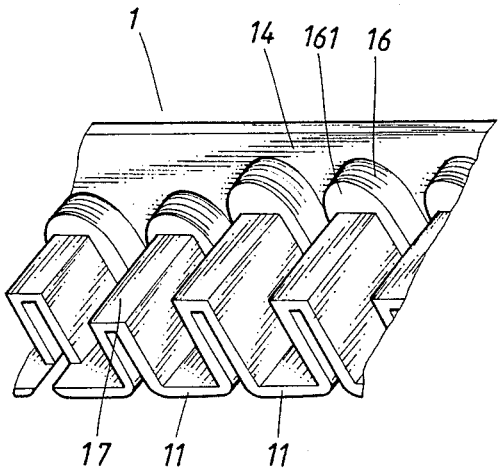
FIG. 2 is a perspective view showing a segment of the resting body of the knife stand in FIG. 1 from the rear side.

Referring now to FIGS. 1 & 2, a knife stand 1 according to the present invention includes a resting body 14 having a front surface and a top surface, a front piece 11 which can be integrally formed to the front surface of body 14, has a plurality of parallel through slits 12 and has the top thereof 13 higher by a height H (FIG. 4A) than the top surface of body 14, and a plurality of positioning means each of which is formed on resting body 4 and capable of positioning thereon the handle of a knife and has a slit A (FIGS. 4B & 4C) corresponding to and communicating with one of through slits 12 so that one can let the blade of the knife pass through the one through slit 12 and have the end of the handle from which the blade is fixed to the handle positioned in the corresponding positioning means and against the rear surface 15 of the top 13. Each of the positioning means can include a receiving room 16 having a bottom 161 on which the above slit A is provided. For better positioning the knife on the present stand, each positioning means can further include a blade limiting frame 17 capable of limiting therein a portion of the blade and communicating with the corresponding through slit 12 on front piece 12 and slit A on bottom 161.

Figure 3:
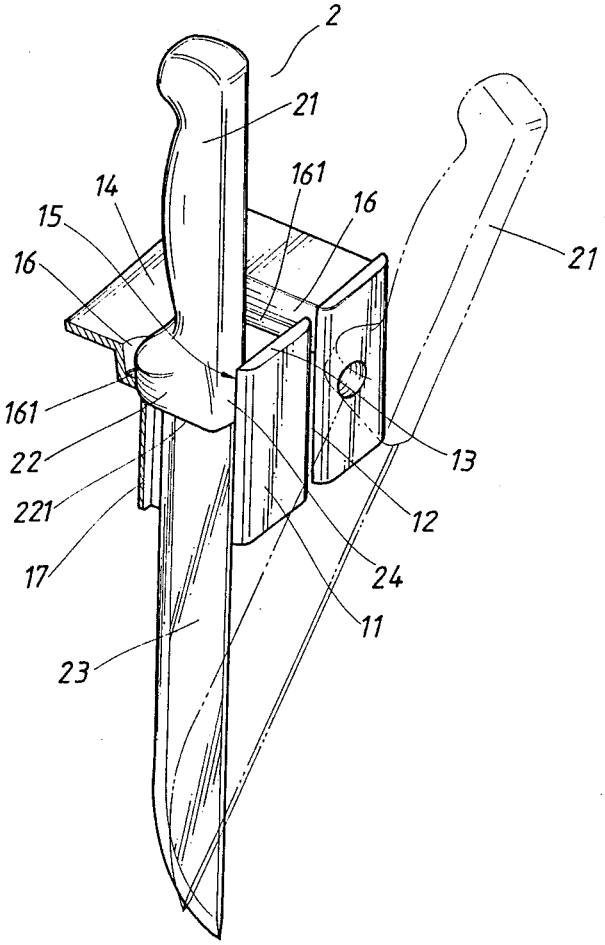
FIG. 3 is a schematic view showing a knife is stored on a knife stand according to the present invention.
Figure 4C:
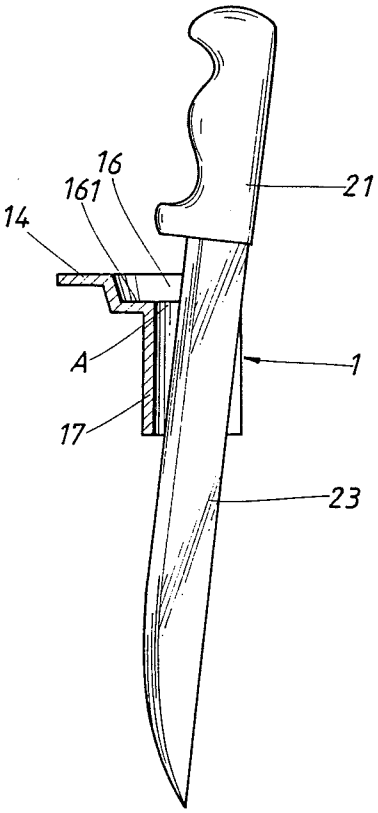
FIGS. 4A–4C are schematic views showing the procedures a knife is taken from a knife stand according to the present invention.
Figure 4B:
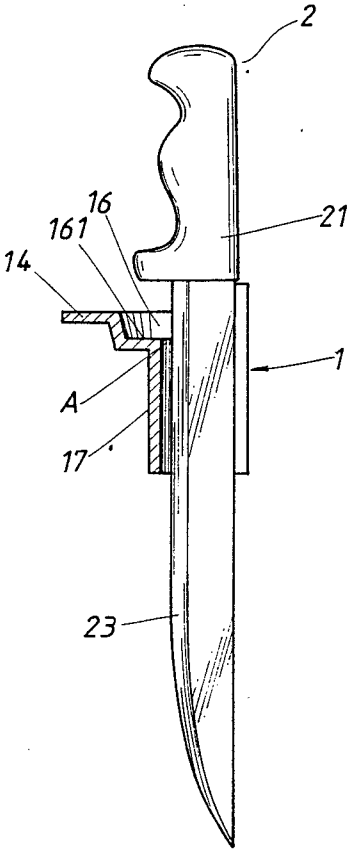
Figure 4A:
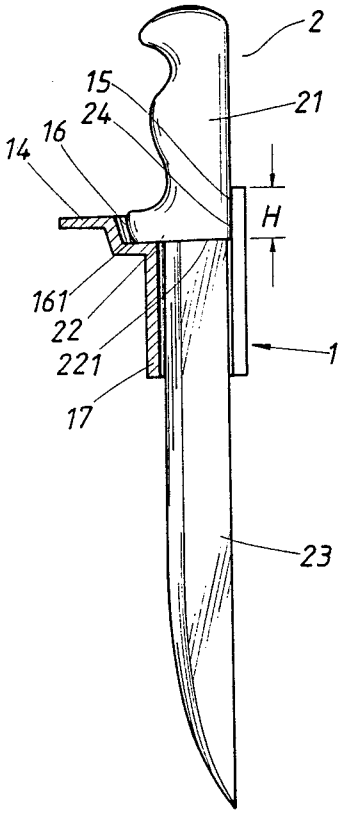

Referring now to FIGS. 3–4C, when a knife 2 is stored in the present stand 1, the end 22 of the handle 21 from which the blade 23 is fixed to handle 21 from which the blade 23 is fixed to handle 21 is positioned in a receiving room 16 and the back 24 of end 22 is against the rear surface 15. When knife 2 is to be fetched from the stand 1, handle 21 is raised up only by a height H and then one can immediately get knife 2 by letting blade 23 pass through through slit 12. When knife 2 is to be replaced on stand 1, knife 2 can automatically drop down to have end surface 221 of end 22 watched against bottom 161 after one has let end 22 pass over top 13.

Figure 5:
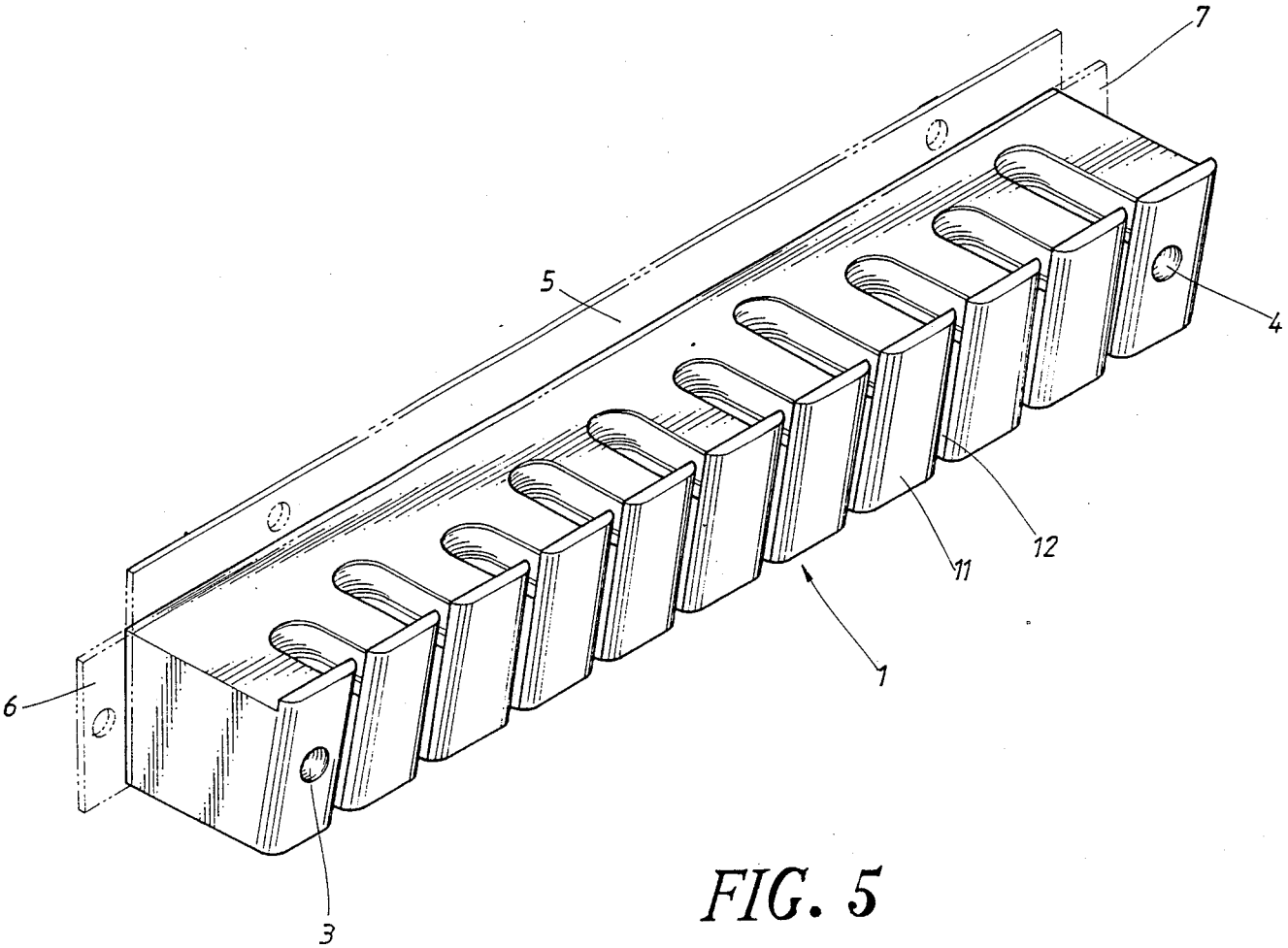
FIG. 5 is a schematic view showing how a knife stand according to the present invention can be secured to a wall in a kitchen.

As shown in FIG. 5, stand 1 itself can be provided with securing holes 3, 4. Alternatively, stand 1 can be provided with mounting extensions 5, 6, 7. As also is well known and as a further alternative, the rear surface of stand 1 can be provided with a self-attaching medium e.g. a Velcro tape.

Figure 7:
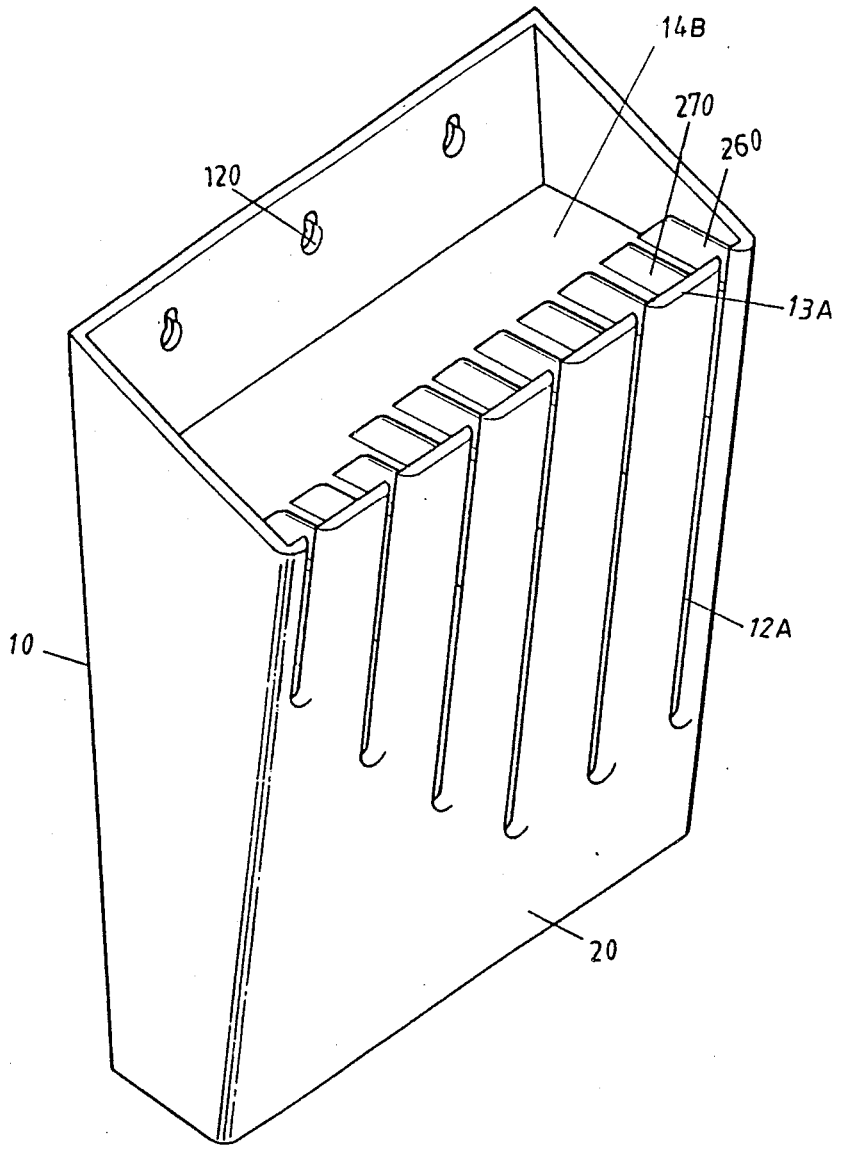
FIG. 7 is a perspective view showing how a receiving room of a knife stand according to the present invention is alternatively constructed.

Alternatively, the receiving room 16 can be constituted by two retaining pieces 260, 270 which comprise rectangular blocks as shown in FIG. 7 positioning therebetween and therein end 22.

Figure 6:
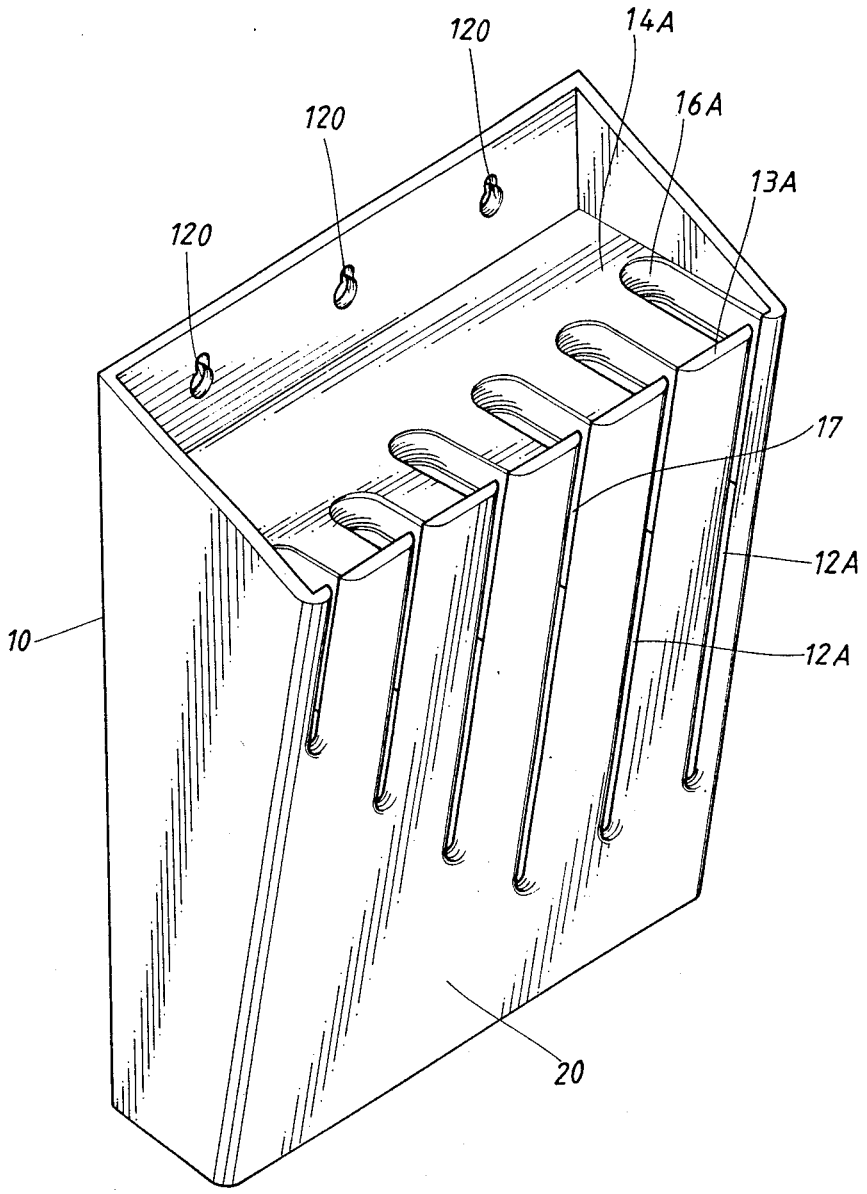
FIG. 6 is a perspective view showing another preferred embodiment of a knife stand according to the present invention.

Referring now to FIGS. 6 & 7, a second preferred embodiment of a knife stand 1 according to the present invention, in which like numerals denote like elements, includes a substantially closed housing having a rear 10 and a front 20 having parallel through slits 12, a reating body 14 received in the housing and having a top surface lower than top 13 of front 20, and a plurality of positioning means each of which is formed body 14 and is the same as that described in the preceding embodiment. Front 20 can be downwardly inclined toward rear 10 and the length of each through slit 12 can be slightly shorter than that of a blade of a knife to be positioned on the corresponding positioning means. The top of rear 10 can be provided with a plurality of hanging holes 120 for enabling stand 1 to be hung on a desired place. It will be noted in FIG. 7 that each positioning means has a thickness relatively small compared with the length and width thereof and a substantial high length and width to thickness ratio.

When knife 2 is stored on such stand 1, blade 23 is entirely contained in the housing and end 22 is well positioned by receiving room 16 and rear surface 15 as in the first embodiment. Since blade 23 is always longer than through slit 12 it passes, the bottom end thereof will contact against the rear surface of front 20 below the respective through slit 12.

Without hanging holes 120, the present stand 1 can still be operating by placing rear 10 against a table. Furthermore, the provision of inclined front 20 on stand 1 will facilitate one's taking knife 2 therefrom.

It can be known from the above description with reference to the accompanying drawings that how and why the present stand can achieve the contemplated objects.

What I claim is:

1. A stand adapted to receive and secure several knives in desired position, each knife having a blade portion and a handle portion, said stand comprising:

a support body having a front piece and an upper rearward extending support piece for said handle portion, said front piece presenting an upper edge spaced above said upper piece, said front piece having a plurality of spaced apart longitudinal slits extending downward from the upper edge towards a bottom edge of said front piece to permit passage of only a knife blade portion into a slit in a manner that said upper piece serves as a support for a handle portion of a knife, at least a portion of said slits continuing into adjacent portions of said upper piece, said upper piece is formed with an upper surface for supporting said handle portions in which said upper surface takes the form of a substantially continuous flat surface common to each said handle portions when supported by said upper surface, and positioning members comprising rectangular blocks arranged parallel to each other projecting from said upper surface of said upper piece in the direction of the upper edge and adjacent said slits to form in cooperation with said front piece and said upper piece receiving pockets for a handle portion of a knife.

2. A stand according to claim 1, wherein said support body has a back surface spaced from said front piece by said upper piece, including means for allowing said stand to be secured in an upright position so that the knives can be arranged in said desired positions.

3. A stand according to claim 2, wherein two said positioning members are provided for each pocket each member having a length extending in the direction between said front piece and said back surface sufficient to maintain a knife in a pocket in said desired position.

4. A stand according to claim 3, wherein each said positioning member has a height extending in a direction away from said flat surface a distance sufficient to effect said maintaining of a knife in a pocket.

5. A stand according to claim 1, wherein said positioning members extend along the support body in a direction away from said front piece.

6. A stand according to claim 5, wherein each said positioning member has a thickness relatively small compared with the length and width thereof.

7. A stand according to claim 5, wherein each said positioning member has a substantial high length and width to thickness ratio.

* * * * *